US010347445B2

(12) United States Patent
Wu

(10) Patent No.: US 10,347,445 B2
(45) Date of Patent: Jul. 9, 2019

(54) MULTI-DIRECTIONAL INPUT DEVICE

(71) Applicant: Fuxi Wu, Dongguan (CN)

(72) Inventor: Fuxi Wu, Dongguan (CN)

(73) Assignee: DONGGUAN CITY KAIHUA ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 15/907,310

(22) Filed: Feb. 28, 2018

(65) Prior Publication Data

US 2018/0190452 A1 Jul. 5, 2018

Related U.S. Application Data

(63) Continuation-in-part of application No. PCT/CN2016/094099, filed on Aug. 9, 2016.

(30) Foreign Application Priority Data

Aug. 30, 2015 (CN) ..... 2015 2 0660681 U

(51) Int. Cl.

| | |
|---|---|
| ***G05G 9/047*** | (2006.01) |
| ***H01H 25/04*** | (2006.01) |
| ***H01H 25/06*** | (2006.01) |

(52) U.S. Cl.

CPC ..... *H01H 25/04* (2013.01); *H01H 25/065* (2013.01); *G05G 9/047* (2013.01); *H01H 2201/026* (2013.01); *H01H 2221/012* (2013.01); *H01H 2221/044* (2013.01); *H01H 2225/004* (2013.01); *H01H 2225/03* (2013.01); *H01H 2231/008* (2013.01)

(58) Field of Classification Search

CPC ..... G05G 9/047; G05G 2009/04733; G05G 2009/04744; H01H 25/04; H01H 25/046; H01H 2201/00; H01H 2221/012; H01H 2221/044; H01H 2225/03; H01H 2231/008

See application file for complete search history.

(56) References Cited

U.S. PATENT DOCUMENTS 3,811,018 A * 5/1974 Kaplan ..... H01H 25/04 200/6 A
4,187,483 A * 2/1980 Whitney ..... H01H 36/006 335/154
4,394,548 A * 7/1983 Dola ..... G05G 9/04796 200/17 R (Continued)

*Primary Examiner* — Vanessa Girardi
(74) *Attorney, Agent, or Firm* — Matthias Scholl P.C.; Matthias Scholl

(57) ABSTRACT

An input device, including: a base, an upper cover, a lever assembly, a reset assembly, an electrical assembly, a spring switch, and a terminal assembly. The upper cover is disposed on the base and includes a central cavity. The lever assembly is disposed in the central cavity formed by the upper cover and the base, and includes a lever, an upper shoulder, and a lower shoulder. The lever includes an upper end and a lower end. The reset assembly is disposed below the lever assembly. The electrical assembly is electrically connected to the lever assembly, and includes a first slider, a second slider, a first carbon-film conductive dome, a first carbon-film resistor, a second carbon-film conductive dome, a second carbon-film resistor, and a trigger. The spring switch is disposed in the base and positioned below the trigger.

5 Claims, 6 Drawing Sheets

(56) References Cited

U.S. PATENT DOCUMENTS

| | | | | | |
|---|---|---|---|---|---|
| 4,406,931 | A * | 9/1983 | Dola | G05G 9/04785 | 200/276 |
| 5,689,285 | A * | 11/1997 | Asher | G05G 9/047 | 200/6 R |
| 7,982,716 | B2 * | 7/2011 | Bowen | G06F 3/0234 | 345/168 |
| 8,723,638 | B2 * | 5/2014 | Guglielmo | G05G 9/047 | 182/141 |
| 9,134,187 | B1 * | 9/2015 | Organ | G05G 9/047 | |
| 9,627,161 | B2 * | 4/2017 | Yamamoto | H01H 25/041 | |

* cited by examiner

MULTI-DIRECTIONAL INPUT DEVICE

CROSS-REFERENCE TO RELATED APPLICATIONS

This application is a continuation-in-part of International Patent Application No. PCT/CN2016/094099 with an international filing date of Aug. 9, 2016, designating the United States, and further claims foreign priority benefits to Chinese Patent Application No. 201520660681.4 filed Aug. 30, 2015. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The disclosure relates to a multi-directional input device.

Description of the Related Art

Typically, video game consoles include a lever, a plurality of flexible films, and a spring switch. The lever is manually controlled to move on the flexible films to produce electrical signals that guide the movement of the cursor on the display screen. However, the sensitivity of the lever with regard to the movement thereof is relatively low, that is, small movement of the lever often fails to produce an electrical signal. This leads to poor control accuracy and imperfect user experience.

SUMMARY OF THE INVENTION

In view of the above-described problems, it is an objective of the disclosure to provide a multi-directional input device that exhibits relatively high input accuracy.

To achieve the objectives above, according to one aspect of the invention, there is provided a multi-directional input device, comprising:

a base;

an upper cover disposed on the base and comprising a central cavity;

a lever assembly, the lever assembly being disposed in the central cavity formed by the upper cover and the base, and comprising a lever, an upper shoulder, and a lower shoulder; the lever comprising an upper end and a lower end; the upper shoulder being in the shape of an arched-bridge and comprising a first central protrusion and a first end and a second end respectively disposed at two sides of the first central protrusion, the first central protrusion comprising a first through hole; the lower shoulder comprising a second central protrusion and a third end and a fourth end respectively disposed at two sides of the second central protrusion, the second central protrusion comprising a second through hole; the upper shoulder being positioned above and perpendicular to the lower shoulder, and the first end and the second end being perpendicular to the third end and the fourth end; the second central protrusion extending into the first central protrusion, a lower end of the lever passing through the first through hole of the upper shoulder and the second through hole of the lower shoulder in sequence and being riveted to the lower shoulder, and the lever driving the upper shoulder and the lower shoulder to swing;

a reset assembly, the reset assembly being disposed below the lever assembly to reset the lever assembly in a tense state;

an electrical assembly, the electrical assembly being electrically connected to the lever assembly to convert a movement signal of the lever assembly into an electrical signal, the electrical assembly comprising a first slider, a second slider, a first carbon-film conductive dome, a first carbon-film resistor, a second carbon-film conductive dome, a second carbon-film resistor, and a trigger; the first/second carbon-film conductive dome being disposed in a space enclosed by the upper cover, the base, and the first/second carbon-film resistor via the first/second slider, and capable of swinging along with the upper shoulder and the lower shoulder, and the trigger contacting a lower end of the lower shoulder to convert a press motion of the lever into an electrical signal;

a spring switch disposed in the base and positioned below the trigger to open and close a circuit; and a terminal assembly configured to output an electrical signal, the terminal assembly comprising a first carbon-film terminal, a second carbon-film terminal, and a switch terminal; the first carbon-film terminal and the second carbon-film terminal being disposed at an outer side of the first carbon-film resistor and the second carbon-film resistor, respectively, and being electrically connected to the first carbon-film conductive dome and the second carbon-film conductive dome via the first/second carbon-film resistor, respectively; and the switch terminal being disposed below the spring switch.

In a class of this embodiment, the reset assembly comprises a reset ring and a spring embedded in the reset ring; one end of the spring abuts against a lower end of the reset ring and the other end abuts against the base.

In a class of this embodiment, a bottom end of the lever is riveted to the lower shoulder via a rivet.

In a class of this embodiment, the first/second carbon-film conductive dome is in the shape of a calabash and is disposed on the first/second slider via a pin; the first carbon-film conductive dome comprises a first opening for receiving an output shaft of the first slider and a first swing portion capable of swinging along with the first slider; the second carbon-film conductive dome comprises a second opening for receiving an output shaft of the second slider and a second swing portion capable of swinging along with the second slider.

In a class of this embodiment, the base comprises a bottom plate and four side walls surrounding the bottom plate; the first carbon-film conductive dome and the first carbon-film conductive resistor are positioned on two adjacent side walls of the base, respectively, and the second carbon-film conductive dome and the second carbon-film conductive resistor are positioned on the other two adjacent side walls of the base, respectively.

Advantages of the input device according to embodiments of the disclosure are summarized as follows:

1. The first/second carbon-film conductive dome of the electrical assembly is disposed in a space enclosed by the upper cover, the base, and the first/second carbon-film resistor via the first/second slider, and swings along with the upper shoulder and the lower shoulder, to convert the movement signal of the lever assembly along the X axis and the Y axis into an electrical signal which is then output by the first carbon-film terminal and the second carbon-film terminal of the terminal assembly. The trigger contacts the lower end of the lower shoulder to convert a press motion of the lever into an electrical signal. The spring switch can close the circuit. Output from the switch terminal can be used to control the cursor on the screen. Since the lever assembly controls directly the change in the motion resistance of the first carbon-film conductive dome with respect to the first carbon-film resistor and of the second carbon-film conductive dome with respect to the second carbon-film resistor and no transmission needs to be conducted by other mechanisms, even a small displacement of the lever can be converted into an electrical signal, improving the control precision of the input device.

2. The reset ring sleeves of the reset assembly for radial positioning of the spring and preventing the spring from deviating in a right/left direction, such that the lever can be accurately reset vertically, further improving the control precision of the input device.
3. The bottom end of the lever is riveted to the lower shoulder via a rivet, such that the lever is in intimate contact with the lower shoulder. As such, even a slight movement of the lever can be transmitted to the lower shoulder and then converted into an electrical signal, thereby further improving the control precision of the input device.
4. The first/second carbon-film conductive dome is in the shape of a calabash and is riveted to the first/second slider. The first/second carbon-film conductive dome comprises an opening for receiving an output shaft of the first/second slider and a swing portion capable of swinging along with the slider under the drive of the upper shoulder/lower shoulder. The first/second carbon-film conductive dome moves in synchronization with the first/second slider, such that even a sight movement of the lever can drive the first/second carbon-film conductive dome to swing, thereby further improving the control precision of the input device.
5. The first and second carbon-film conductive domes are provided on two adjacent side walls of the base, respectively, and are disposed between the side wall and the first/second carbon-film resistors, such that the input device has a larger height and a larger size, and exhibits relatively high input accuracy.

DETAILED DESCRIPTION OF THE EMBODIMENTS

Figure 1:
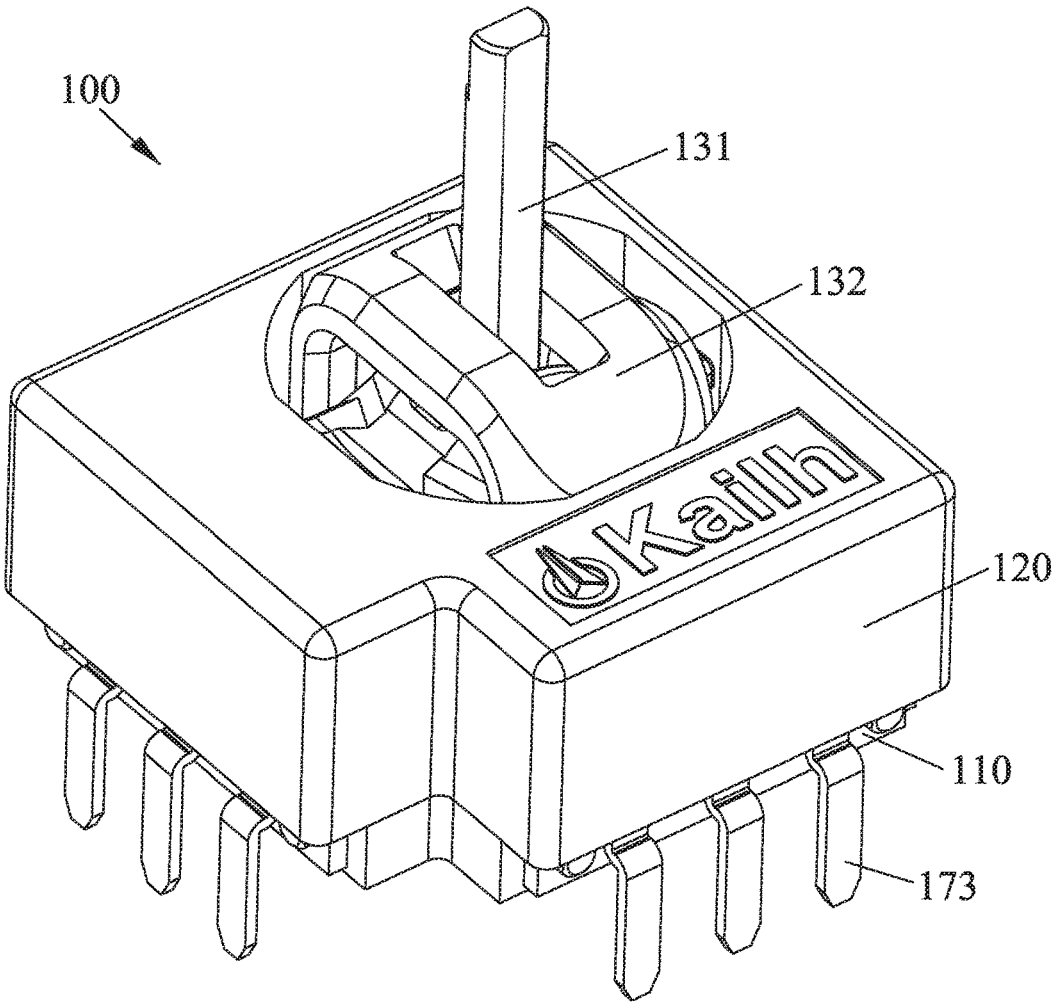
FIG. 1 is a three-dimensional view of a multi-directional input device according to the disclosure.
Figure 2:
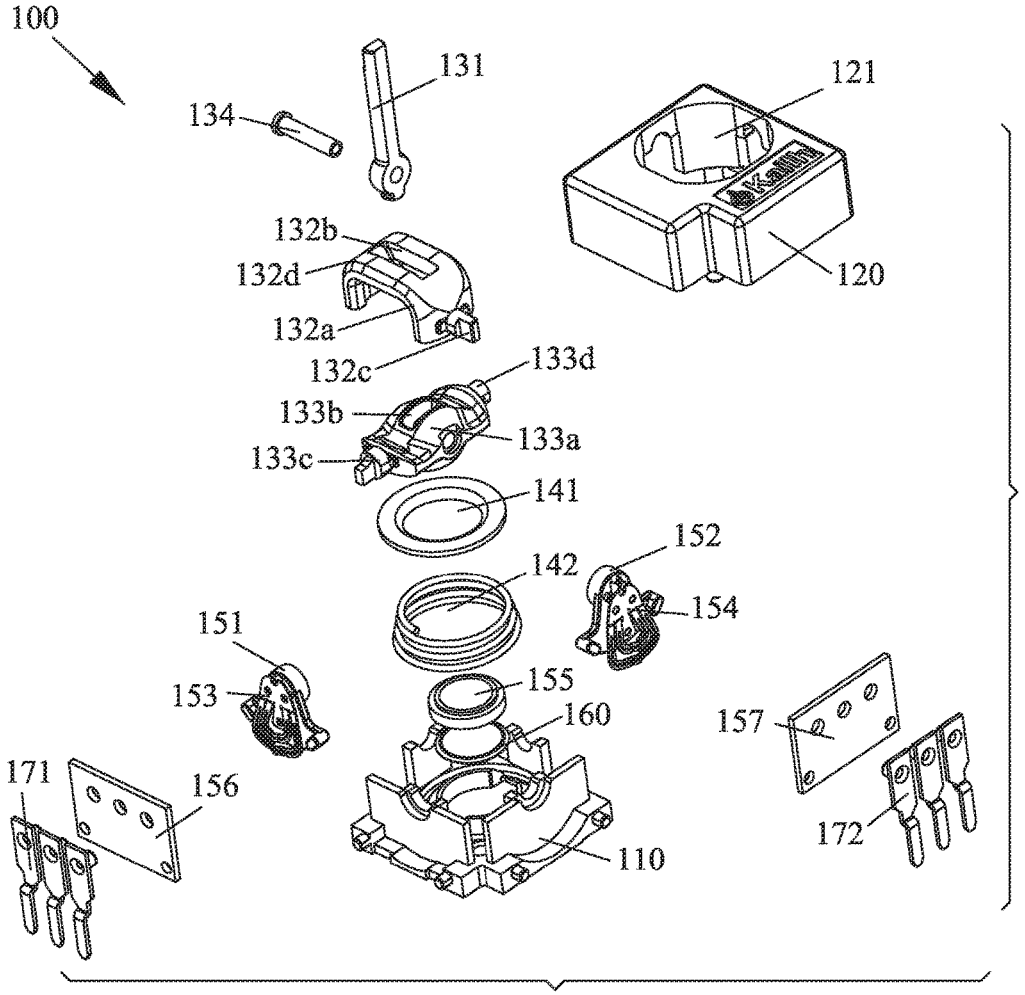
FIG. 2 is an exploded view of a multi-directional input device according to the disclosure.
Figure 3:
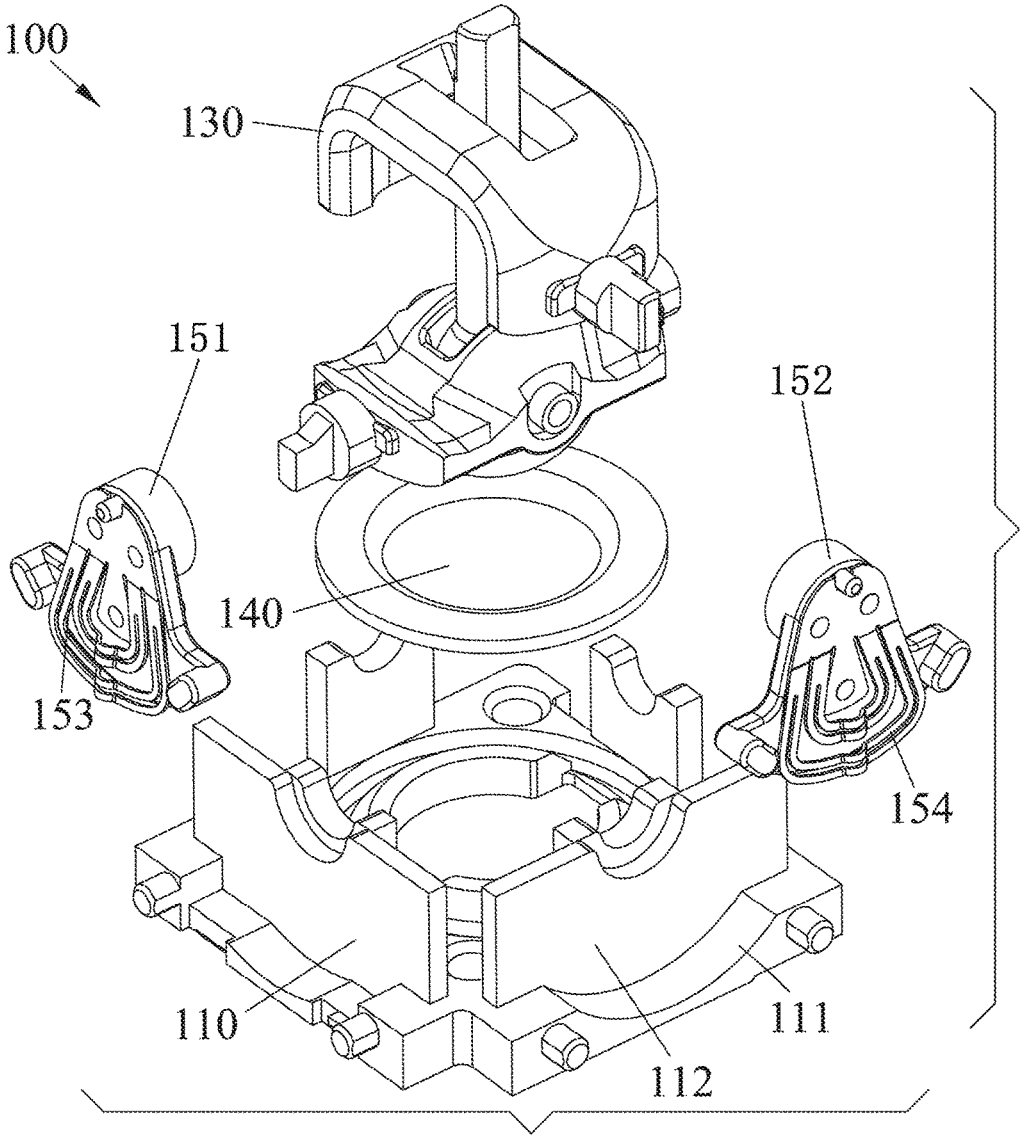
FIG. 3 is another exploded view of a multi-directional input device according to the disclosure.
Figure 4:
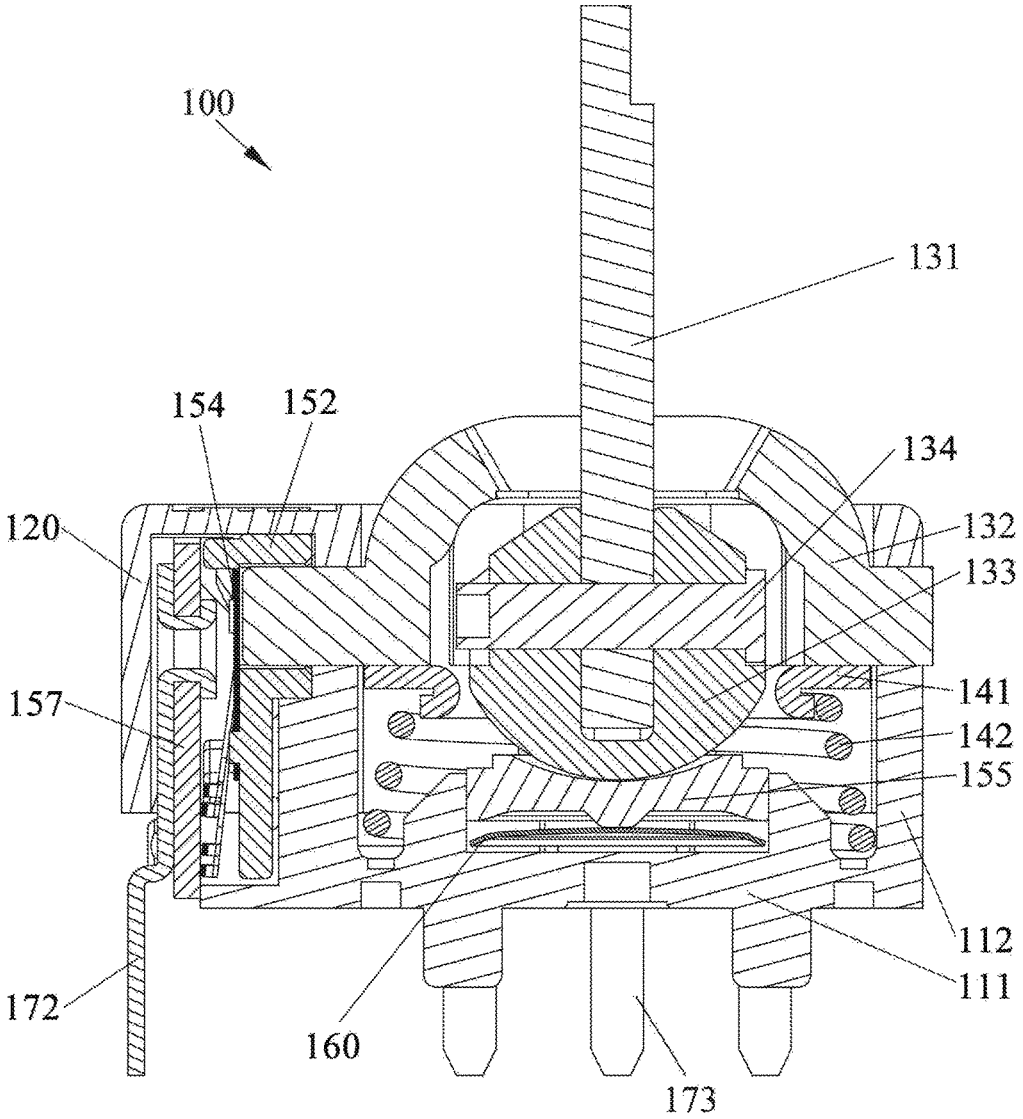
FIG. 4 is a cross-sectional view of a multi-directional input device according to the disclosure.
Figure 5:
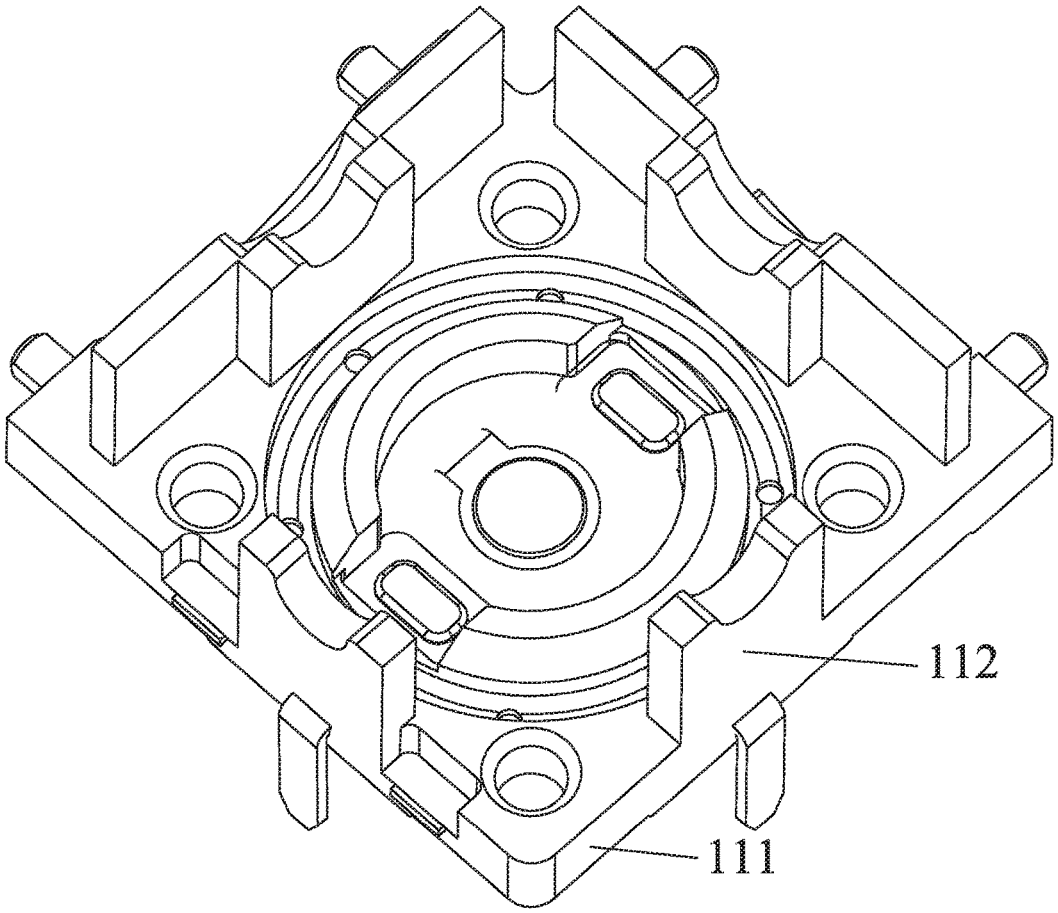
FIG. 5 is a schematic diagram of a base of a multi-directional input device according to the disclosure.

FIGS. 1 to 5 show an exploded view, a three-dimensional view, and a cross-sectional view of a high-precision multi-directional input device according to the disclosure.

A high-precision multi-directional input device 100 comprises a base 110, an upper cover 120, a lever assembly 130, a reset assembly 140, an electrical assembly, a spring switch 160, and a terminal assembly.

The base 110 comprises a bottom plate 111 and four side walls 112 surrounding the bottom plate. The first carbon-film conductive dome 153 and the first carbon-film conductive resistor 156 are positioned on two adjacent side walls 112 of the base 110, respectively, and the second carbon-film conductive dome 154 and the second carbon-film conductive resistor 157 are positioned on the other two adjacent side walls 112 of the base 110, respectively.

The upper cover 120 is disposed on the base 110 and comprises a central cavity 121 provide at the center.

The lever assembly 130 is disposed in a space formed by the upper cover 120 and the base 110, and comprises a lever 131, an upper shoulder 132, and a lower shoulder 133. The lever 131 comprises an upper end and a lower end. The upper shoulder 132 is in an arced-bridge shape. The upper shoulder 132 comprises a first central protrusion 132*a* projecting from the center, a first end 132*c* and a second end 132*d* respectively disposed at two sides of the first central protrusion, and the first central protrusion 132*a* comprises a first through hole 132*b*. The lower shoulder 133 comprises a second central protrusion 133*a* projecting from the center, and a third end 133*c* and a fourth end 133*d* respectively disposed at two sides of the second central protrusion 133*a*. The second central protrusion comprises a second through hole 133*b*. The upper shoulder 132 is positioned above and perpendicular to the lower shoulder 133, and the first end 132*c* and the second end 132*d* are perpendicular to the third end 133*c* and the fourth end 133*d*. The second central protrusion 133*a* extends into the first central protrusion 132*a*. The lower end of the lever 131 passes through the first through hole 132*b* in the upper shoulder 132 and the second through hole 133*b* in the lower shoulder 133 in sequence. The lever 131 drives the upper shoulder 132 and the lower shoulder 133 to swing. The bottom end of the lever 131 is riveted to the lower shoulder 133 via a rivet 134.

The reset assembly 140 is disposed below the lever assembly 130 for resetting the lever assembly 130 that has been pressed or swung in any direction. The reset assembly 140 comprises a reset ring 141 and a spring 142 embedded in the reset ring 141. One end of the spring 142 abuts against a lower end of the reset ring 141 and the other end abuts against the base 110.

The electrical assembly is electrically controlled by the lever assembly 130 for converting a movement signal of the lever assembly 130 into an electrical signal. The electrical assembly comprises a first slider 151, a second slider 152, a first carbon-film conductive dome 153, a first carbon-film resistor 156, a second carbon-film conductive dome 154, a second carbon-film resistor 157, and a trigger 155. The first/second carbon-film conductive dome 153/154 is disposed in a space enclosed by the upper cover 120, the base 110, and the first/second carbon-film resistor 156/157 via the first/second slider 151/152, and swings along with the upper shoulder 132 and the lower shoulder 133 so as to convert a movement signal of the lever assembly 130 along an X axis and a Y axis into an electrical signal. The trigger 155 contacts the lower end of the lower shoulder 133 so as to convert a press motion of the lever 131 into an electrical signal.

The spring switch 160 is disposed in the base 110 and positioned below the trigger 155 to open and close a circuit.

The terminal assembly configured to output an electrical signal comprises a first carbon-film terminal 171, a second carbon-film terminal 172, and a switch terminal 173. The first carbon-film terminal 171 and the second carbon-film terminal 172 are disposed at an outer side of the first carbon-film resistor 156 and the second carbon-film resistor 157, and are electrically connected to the first carbon-film conductive dome 153 and the second carbon-film conductive dome 154 via the first/second carbon-film resistor 156/157. The switch terminal 173 is disposed below the spring switch 160.

Figure 6:
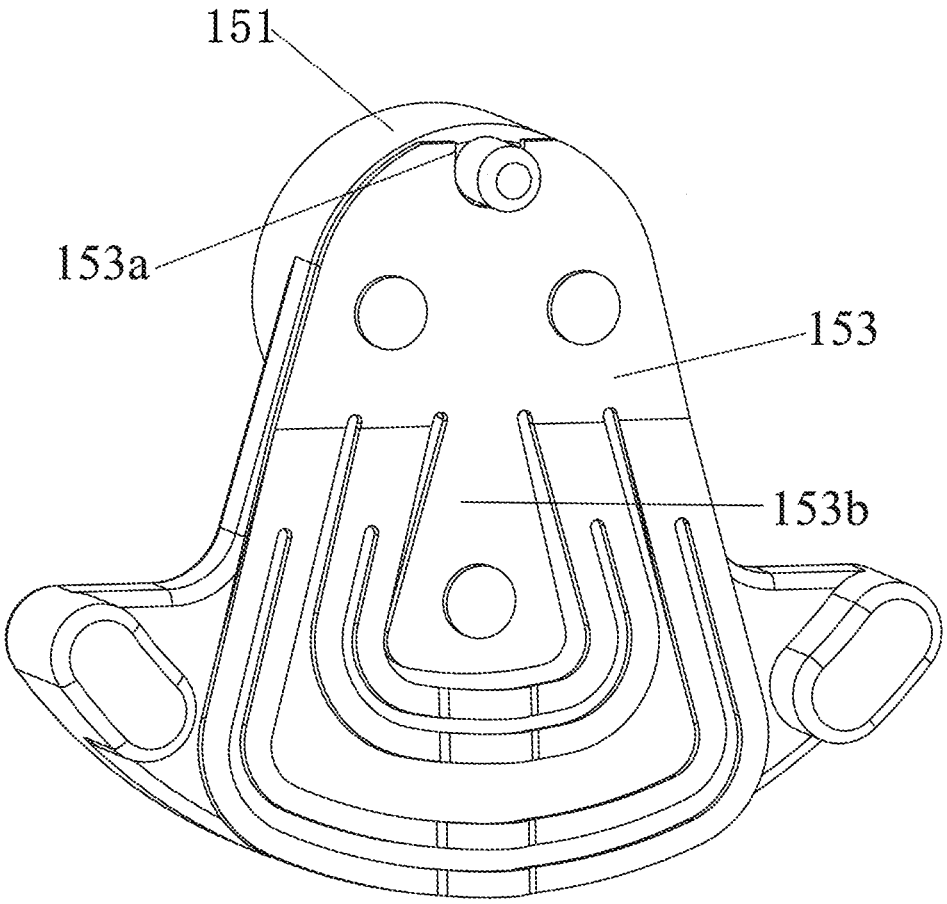
FIG. 6 is a schematic diagram of a carbon-film conductive dome of a multi-directional input device according to the disclosure.

FIG. 6 shows a schematic structural view of a carbon-film conductive dome in the high-precision multi-directional input device according to the disclosure. The first/second carbon-film conductive dome 153/154 is in the shape of a calabash and is disposed on the first/second slider 151/152 via a pin. The first/second carbon-film conductive dome 153/154 comprises an opening 153*a* for receiving an output shaft of the first/second slider 151/152 and a swing portion 153*b* that is driven to swing along with the slider by the upper shoulder 132/lower shoulder 133.

The input device of the disclosure features the following beneficial effects.

The first/second carbon-film conductive dome 153/154 of the electrical assembly is disposed in a space enclosed by the upper cover 120, the base 110, and the first/second carbon-film resistor 156/157 via the first/second slider 151/152 and swings along with the upper shoulder 132 and the lower shoulder 133, so as to convert a movement signal of the lever assembly 130 along the X axis and the Y axis into an electrical signal by a first carbon-film terminal 171 and a second carbon-film terminal 172 of the terminal assembly. The trigger 155 contacts the lower end of the lower shoulder 133 to convert a press motion of the lever 131 into an electrical signal. The spring switch can close the circuit. Output from the switch terminal 173 can be used to control the cursor on the screen. Since the lever assembly 130 controls directly the change in the motion resistance of the first carbon-film conductive dome 153 with respect to the first carbon-film resistor 156 and of the second carbon-film conductive dome 154 with respect to the second carbon-film resistor 157 and no transmission needs to be conducted by other mechanisms, even a small displacement of the lever 131 can be converted into an electrical signal, thereby improving the control precision of the input device.

The reset ring 141 sleeves 142 of the reset assembly 140 for radial positioning of the spring 142 and preventing the spring from deviating in a right/left direction, such that the lever 131 can be accurately reset vertically, thereby further improving the control precision of the input device.

The bottom end of the lever 131 is riveted to the lower shoulder 133 via a rivet 134, such that the lever 131 is in intimate contact with the lower shoulder 133. As such, even a slight movement of the lever 131 can be transmitted to the lower shoulder 133 and then converted into an electrical signal, thereby further improving the control precision of the input device.

The first/second carbon-film conductive dome 153/154 is in the shape of a calabash and is riveted to the first/second slider 151/152. The first/second carbon-film conductive dome 153/154 comprises an opening 153*a* for receiving an output shaft of the first/second slider 151/152 and a swing portion 153*b* that can be driven to swing along with the slider by the upper shoulder 132/lower shoulder 133. The first/second carbon-film conductive dome 153/154 moves in synchronization with the first/second slider 151/152, such that even a sight movement of the lever 131 can drive the first/second carbon-film conductive dome 153/154 to swing, thereby further improving the control precision of the input device.

The first and second carbon-film conductive domes 153 and 154 are provided on two adjacent side walls 112 of the base 110, respectively, and are disposed between the side wall 112 and the first/second carbon-film resistors 156 and 157, respectively, such that the input device has a larger height and a larger size, and exhibits relatively high input accuracy.

The input device is operated in the following manner.

The lever 131 is moved left and right and back and forth, such that the first carbon-film conductive dome 153 and the second carbon-film conductive dome 154 are driven to swing by the upper shoulder 132 and lower shoulder 133, to acquire a track of movement of the lever 131 in the X axis and the Y axis. The signal indicative of the movement is converted into an electrical signal. The lever 131 is pressed and moves downward to come into contact with the trigger 155, and drives the trigger 155 to move downward so as to close the circuit. The electrical assembly converts the track of movement of the lever assembly 130 into an electrical signal, so as to control the cursor on the screen. When the lever 131 is released, the lever 131 is reset by the reset assembly 140, such that the lower shoulder 132, the trigger 155, and the spring switch 160 moves out of contact with the terminal assembly, and the circuit is opened.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An input device, comprising:

a base;

an upper cover disposed on the base and comprising a central cavity;

a lever assembly, the lever assembly being disposed in the central cavity formed by the upper cover and the base, and comprising a lever, an upper shoulder, and a lower shoulder; the lever comprising an upper end and a lower end; the upper shoulder being in the shape of an arched-bridge and comprising a first central protrusion and a first end and a second end respectively disposed at two sides of the first central protrusion, the first central protrusion comprising a first through hole; the lower shoulder comprising a second central protrusion and a third end and a fourth end respectively disposed at two sides of the second central protrusion, the second central protrusion comprising a second through hole; the upper shoulder being positioned above and perpendicular to the lower shoulder, and the first end and the second end being perpendicular to the third end and the fourth end; the second central protrusion extending into the first central protrusion, a lower end of the lever passing through the first through hole of the upper shoulder and the second through hole of the lower shoulder in sequence and being riveted to the lower shoulder, and the lever driving the upper shoulder and the lower shoulder to swing;

a reset assembly, the reset assembly being disposed below the lever assembly to reset the lever assembly in a tense state;

an electrical assembly, the electrical assembly being electrically connected to the lever assembly to convert a movement signal of the lever assembly into an electrical signal, the electrical assembly comprising a first carbon-film conductive dome, a first carbon-film resistor, a second carbon-film conductive dome, a second carbon-film resistor, and a trigger; the first/second carbon-film conductive dome being disposed in a space enclosed by the upper cover, the base, and the first/second carbon-film resistor, and capable of swinging along with the upper shoulder and the lower shoulder, and the trigger contacting a lower end of the lower shoulder to convert a press motion of the lever into an electrical signal;

a spring switch disposed in the base and positioned below the trigger to open and close a circuit; and a terminal assembly configured to output an electrical signal, the terminal assembly comprising a first carbon-film terminal, a second carbon-film terminal, and a switch terminal; the first carbon-film terminal and the second carbon-film terminal being disposed at an outer side of the first carbon-film resistor and the second carbon-film resistor, respectively, and being electrically connected to the first carbon-film conductive dome and the second carbon-film conductive dome via the first/second carbon-film resistor, respectively; and the switch terminal being disposed below the spring switch.

2. The device of claim 1, wherein the reset assembly comprises a reset ring and a spring embedded in the reset ring, with one end of the spring abutting against a lower end of the reset ring and the other end abutting against the base.

3. The device of claim 2, wherein a bottom end of the lever is riveted to the lower shoulder via a rivet.

4. The device of claim 3, wherein the first/second carbon-film conductive dome is in the shape of a calabash and is disposed on a first/second slider via a pin; the first carbon-film conductive dome comprises a first opening for receiving an output shaft of the first slider and a first swing portion capable of swinging along with the first slider; and the second carbon-film conductive dome comprises a second opening for receiving an output shaft of the second slider and a second swing portion capable of swinging along with the second slider.

5. The device of claim 4, wherein the base comprises a bottom plate and four side walls surrounding the bottom plate; the first carbon-film conductive dome and the first carbon-film conductive resistor are positioned on two adjacent side walls of the base, respectively, and the second carbon-film conductive dome and the second carbon-film conductive resistor are positioned on the other two adjacent side walls of the base, respectively.

* * * * *